US009196236B1

(12) United States Patent
Buese

(10) Patent No.: US 9,196,236 B1
(45) Date of Patent: Nov. 24, 2015

(54) ELECTRONIC MUSIC INSTRUMENT, SYSTEM AND METHOD FOR OPERATING AN ELECTRONIC MUSIC INSTRUMENT

(71) Applicant: NATIVE INSTRUMENTS GmbH, Berlin (DE)

(72) Inventor: Matthias Buese, Berlin (DE)

(73) Assignee: Native Instruments GmbH, Berlin (DE)

( * ) Notice: Subject to any disclaimer, the term of this patent is extended or adjusted under 35 U.S.C. 154(b) by 0 days.

(21) Appl. No.: 14/474,736

(22) Filed: Sep. 2, 2014

(51) Int. Cl.
*G10H 1/18* (2006.01)
*G10H 1/34* (2006.01)
*G10H 1/00* (2006.01)

(52) U.S. Cl.
CPC ..... *G10H 1/18* (2013.01); *G10H 1/0066* (2013.01); *G10H 1/34* (2013.01); *G10H 2220/221* (2013.01)

(58) Field of Classification Search
USPC ..... 84/615
IPC ..... G10H 1/18
See application file for complete search history.

(56) References Cited

U.S. PATENT DOCUMENTS 5,317,641 A * 5/1994 Yasuda et al. ..... 381/119
5,933,505 A * 8/1999 Bargauan ..... 381/119
7,005,571 B1 * 2/2006 Groff ..... 84/645
7,145,070 B2 * 12/2006 Barry ..... 84/723
7,441,193 B1 * 10/2008 Wild et al. ..... 715/733
7,847,792 B2 * 12/2010 Ketterer et al. ..... 345/184
8,835,739 B2 * 9/2014 Bencar et al. ..... 84/615
8,839,193 B1 * 9/2014 Devane et al. ..... 717/111
8,923,533 B2 * 12/2014 Aiso ..... 381/119
2003/0233158 A1 * 12/2003 Aiso et al. ..... 700/94
2004/0015252 A1 * 1/2004 Aiso et al. ..... 700/94
2004/0104703 A1 * 6/2004 Aiso et al. ..... 318/568.19
2004/0172144 A1 * 9/2004 Suyama et al. ..... 700/52
2005/0092163 A1 * 5/2005 Aiso et al. ..... 84/625
2007/0279400 A1 * 12/2007 Iwamura ..... 345/184
2008/0271594 A1 * 11/2008 Starr ..... 84/646
2009/0019993 A1 * 1/2009 Mizuhiki et al. ..... 84/604
2009/0133567 A1 * 5/2009 Okano et al. ..... 84/609
2009/0223352 A1 * 9/2009 Matsuda et al. ..... 84/612
2009/0308231 A1 * 12/2009 Mizuhiki et al. ..... 84/622
2010/0020673 A1 * 1/2010 Flum et al. ..... 369/264
2010/0180224 A1 * 7/2010 Willard et al. ..... 715/773
2010/0269670 A1 * 10/2010 O'Connor et al. ..... 84/626
2011/0025455 A1 * 2/2011 Whalen et al. ..... 340/4.1
2012/0030626 A1 * 2/2012 Hopkins et al. ..... 715/833
2013/0076542 A1 * 3/2013 Tanaka et al. ..... 341/22
2014/0254834 A1 * 9/2014 Umeo ..... 381/119
2015/0029145 A1 * 1/2015 Hlatky et al. ..... 345/174
2015/0107444 A1 * 4/2015 Pezeshkian ..... 84/645

* cited by examiner

*Primary Examiner* — David Warren
(74) *Attorney, Agent, or Firm* — Novak Druce Connolly Bove + Quigg LLP

(57) ABSTRACT

An electronic music instrument comprises at least one rotary encoder with a knob configured for setting a value of a parameter of the instrument; at least one input configured for receiving at least one of a base value of the parameter and a modulation offset of the parameter; and a visual indicator associated with the encoder configured for indicating the base value of the parameter and the modulation offset of the parameter.

16 Claims, 4 Drawing Sheets

Figure 1:
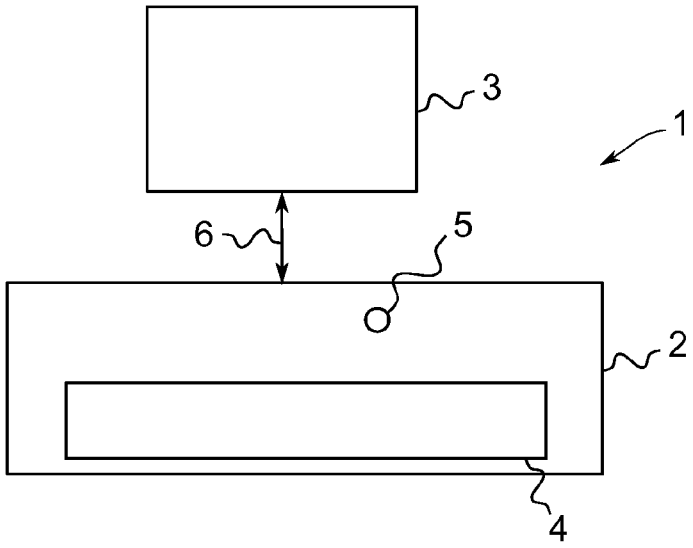

ELECTRONIC MUSIC INSTRUMENT, SYSTEM AND METHOD FOR OPERATING AN ELECTRONIC MUSIC INSTRUMENT

The present invention relates to an electronic music instrument, a system comprising the electronic music instrument and a data processing device and a method for operating an electronic music instrument.

Today, most software instruments have an internal modulation engine for changing or modulating one or more parameters of the instrument. The software instrument can be a simulation or emulation of an instrument or it can be an electronic instrument like for example a synthesizer. In the field of music, a signal processing unit or a mixer may also comprise an internal modulation engine.

A parameter can be changed not only through interaction with the respective on-screen control element, or through MIDI (Musical Instrument Digital Interface) via a correspondingly mapped hardware control, but also commonly through additional oscillators, sequencers or envelope followers that are computed inside the instrument. The changing of the parameter is usually visualized on the computer screen in the respective software window, by e.g. a value bar at the virtual control's on-screen visualization. When operating the instrument inside a digital audio workstation (DAW) environment, there is, however, a further way of changing a parameter by using digital audio workstation automation. A user can sequence the changing of a parameter's value over time in the workstation's timeline. The corresponding changing of the parameter is also usually visualized on the computer screen in the respective software window. The changing of the parameter is then executed through the instrument's application programming interface (API).

However, there is an important semantic difference between modulating a parameter inside the instrument and changing a parameter from the digital audio workstation. The instrument's own modulation is temporarily added to the parameter, while not changing its value, while the digital audio workstation changing through the API sets the parameters value, similar as changing the parameter through the instrument's graphical user interface or through MIDI.

This difference is reflected in the graphical user interface of the digital audio workstation: A change of the parameter sets the virtual control's value e.g. on a knob control and the value-indicating handle is redrawn on the screen of the digital audio workstation to reflect the value.

The change introduced through a modulation does normally not redraw the control's handle. Instead, an indicator is shown on the computer screen where the control's handle would currently be if the modulation would be a parameter change. Or, in other words, the modulation changes the parameter only momentarily, while the parameter change through the plugin interface is permanent, and any modulation inside the instrument is added to this new parameter value.

Thereby arises the problem that the current value of a parameter is not always transparent to the user.

This problem is solved according to the invention by an electronic music instrument according to claim 1, a system comprising the electronic music instrument and a data processing device according to claim 10 and a method for operating an electronic music instrument according to claim 13, respectively.

According to an aspect of the present invention an electronic music instrument comprises at least one rotary encoder with a knob configured for setting a value of a parameter of the instrument; at least one input configured for receiving at least one of a base value of the parameter and a modulation offset of the parameter; and a visual indicator associated with the encoder configured for indicating the base value of the parameter and the modulation offset of the parameter. The visual indicator provides a user with additional visual feedback on the hardware without having to look at a computer screen thereby enhancing usability and comfort of the electronic music instrument. The visual indicator indicates or displays the parameter's base value, i.e. the permanent or fix value which remains until changed or reset. Further, the visual indicator indicates or displays the parameter's modulation offset, i.e. a temporary offset to the base value. By this arrangement, the user or player is informed about all influences to a parameter or a value of a parameter of the electronic music instrument directly at the music instrument. The input may be an input for external signals like from a computer such as a digital audio workstation. The input may be an internal input configured for example for receiving a modulation offset or it may be an external input configured for receiving at least one of a base value of the parameter and a modulation offset for example from a sound generating device like an instrument, a digital audio workstation or the like.

The electronic musical instrument may be a MIDI controller, a synthesizer or a sample-based instrument. The electronic music instrument may further be a keyboard, synthesizer, DJ controller, pad controller, matrix controller, 4×4 controller, step sequencer, a controlling device for music production or the like configured for generating and/or affecting note or sound events. The rotary encoder with the accompanied visual indicator is especially useful for such electronic musical instruments. For the first time, this combination gives information about external influences like from a digital audio workstation and internal influences like from an internal modulation engine at the instrument itself while playing the instrument. The player of the instrument can keep his attention on the instrument and still receives information with regard to parameter changes not originating directly from the player.

The visual indicator may comprise a plurality of LEDs. The visual indicator may comprise a ring of LEDs wherein each LED marks a position or value of the parameter. The LEDs allow for easy assessment of the parameter's value. In an alternative setting a liquid crystal display (LCD) is implemented which may have a finer resolution. In the case of an LCD the name and/or one or more values of the parameter can be displayed close to encoder which eases handling of the signal processing apparatus.

The visual indicator may be ring-shaped at least partly surrounding the knob. Such an arrangement allows for direct assignment or association of the visual indicator and the encoder. Preferably, the visual indicator and the knob are arranged in a concentric manner. Readability of the visual indicator is thus enhanced.

The visual indicator may be configured for indicating the modulation offset starting at the base value. In a way, this indication is an optical subtraction or addition of the base value and the modulation offset. The user is enabled to see the base value, the modulation offset and their difference at one glance. While the base value may be seen as a zero or fixed point or line the modulation offset may be seen as a value bar or range.

The visual indicator may be configured for temporarily changing it's appearance when a base value of the parameter or a modulation offset of the parameter is received. The change in appearance may include pulsating or flashing, changing hue, brilliance and/or saturation or the like. The change may occur temporarily and periodically. The changing visual indicator shows a user immediately that a change to the parameter was received even when the amount of the parameter's change is below a resolution of the visual indicator. The duration of the changing in appearance can be adjusted to the user's needs and/or the extent of the parameter change.

The rotary encoder may be an absolute encoder and the visual indicator may comprise a light emitting indicator configured for displaying the modulation offset and a hardware pointer configured for displaying the base value. Such a partition or division of the visual indicator into a light emitting indicator and a hardware pointer renders absolute encoders capable of cooperating with the idea of visualizing the base value and the modulation offset at the same time. While the hardware pointer corresponds to the actual position or axial orientation of the encoder, the light emitting indicator indicates by adjusting it's luminance, hue, saturation and/or illuminated area or range the variable offset caused by modulation of the parameter. The light emitting indicator may be realized by a number of LEDs such as an LED ring for example or by an LCD (Liquid Crystal Display), a TFT display (Thin Film Transistor), an OLED display (Organic Light Emitting Diode) or the like.

The rotary encoder may be a relative encoder and the visual indicator may comprise a light emitting indicator configured for displaying the modulation offset and the base value. Now, both information elements, i.e. base value and offset are displayed by the light emitting indicator of the visual indicator. By this arrangement, the degree of freedom of the relative or incremental encoder can be fully used and the information with regard to the parameter is displayed only by the visual indicator.

The parameter may be an instrument or play assistant parameter, like for example cutoff, boost, bandwidth, reverb and/or decay. These are important parameters which can be changed during play. Hence, information about changes to these parameters allows the player to adjust his play.

The electronic music instrument may further comprise an internal modulation engine for providing a modulation offset of the parameter to the input. Such an internal modulation engine changes or modulates a parameter without direct influence of the user or player. Therefore, it is beneficial to display changes to the parameter induced by such a modulation directly at the encoder in front of the user. As the user or player changes the parameter via the encoder it is an intuitive design to display parameter changes to the user at this place.

According to another aspect of the present invention a system comprising the electronic music instrument as described above and a data processing device is provided. Such a system can for example be implemented with benefit in the music industry. In this case the electronic music instrument may be a MIDI controller, a keyboard instrument or the like while the data processing device may be a digital audio workstation or for example any other sound generating device.

The data processing device may be a digital audio workstation and may be configured for providing a base value of the parameter to the input. A digital audio workstation usually directly changes the base value of a parameter which is commonly called DAW automation. For the user it is important to be informed about such an important non-temporary change directly at the instrument in front of him.

A controller configured for providing a base value of the parameter may be connected to the data processing device and the data processing device may be configured for providing the base value of the parameter to the input. For example a MIDI controller can be attached to the digital audio workstation. Such a MIDI controller directly influences the base value of the parameter. In such a setting it also beneficial to inform the user about changes to the parameter.

According to a further aspect of the present invention a method for operating an electronic music instrument having at least one rotary encoder with a knob includes setting a value of a parameter of the instrument by rotating the knob; receiving at least one of a base value of the parameter and a modulation offset of the parameter; and indicating the base value of the parameter and the modulation offset of the parameter by a visual indicator associated with the encoder. As mentioned before, the combined display of a fix base value and a variable modulation offset directly at the encoder and therefore in front of the user eases handling of the instrument.

An indication of the modulation offset may start at an indication of the base value. In a way, this indication is an optical subtraction or addition of the base value and the modulation offset. The user is enabled to see the base value, the modulation offset and their difference at one glance. While the base value may be seen as a zero or fixed point or line the modulation offset may be seen as a value bar or range.

The modulation offset may be displayed by a light emitting indicator and the base value may be displayed by a hardware pointer. Spreading the visual indication to a light emitting indicator and a hardware pointer allows advantageously the use of absolute encoders. The absolute encoder may have a motor for driving the encoder or it's knob according to changes to the parameter. Preferably, only changes to the base value of the parameter induce movement of the motor. The temporary and usually faster movements of the modulation offset are displayed by the light emitting indicator.

The base value and the modulation offset may be displayed by a light emitting indicator. This arrangement is beneficial for a relative encoder. The relative signals can be used to calculate and display the position and/or range of the base value and the modulation offset in the light emitting indicator.

Figure 2:
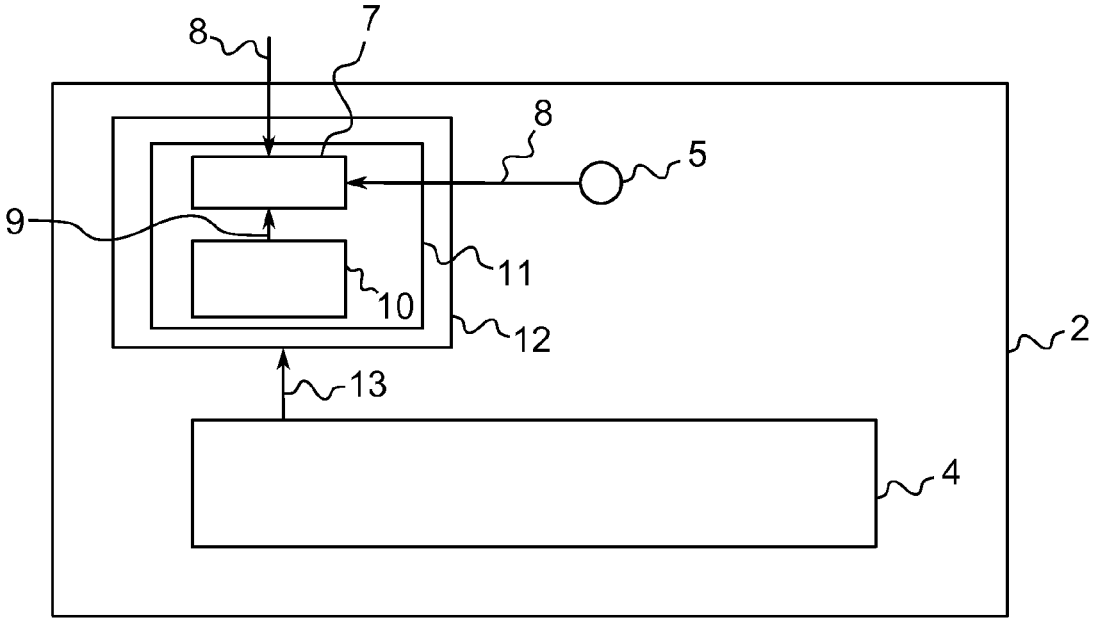

Exemplary embodiments of the invention will now be described in more detail with reference to the Figures which show in FIG. 1 a schematic diagram of a system of an electronic music instrument and a digital audio workstation;

FIG. 2 a schematic diagram of the electronic music instrument; and

Figure 3:
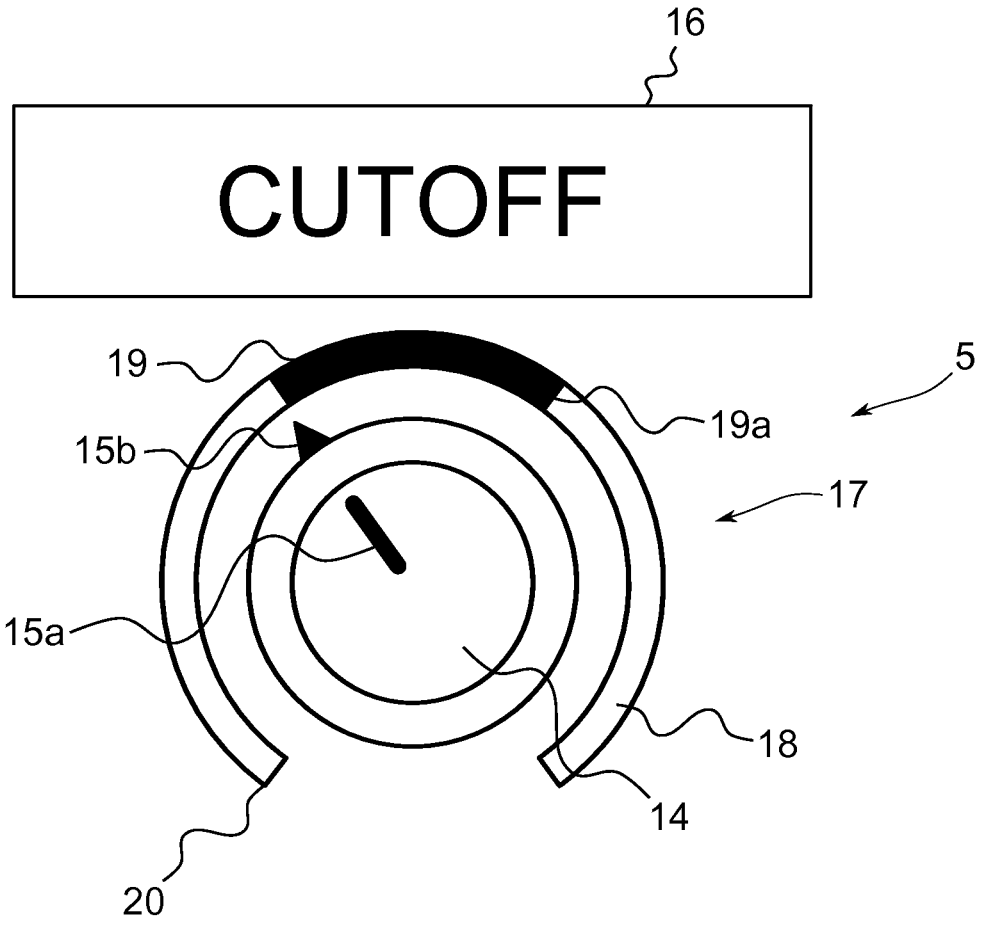
Figure 4:
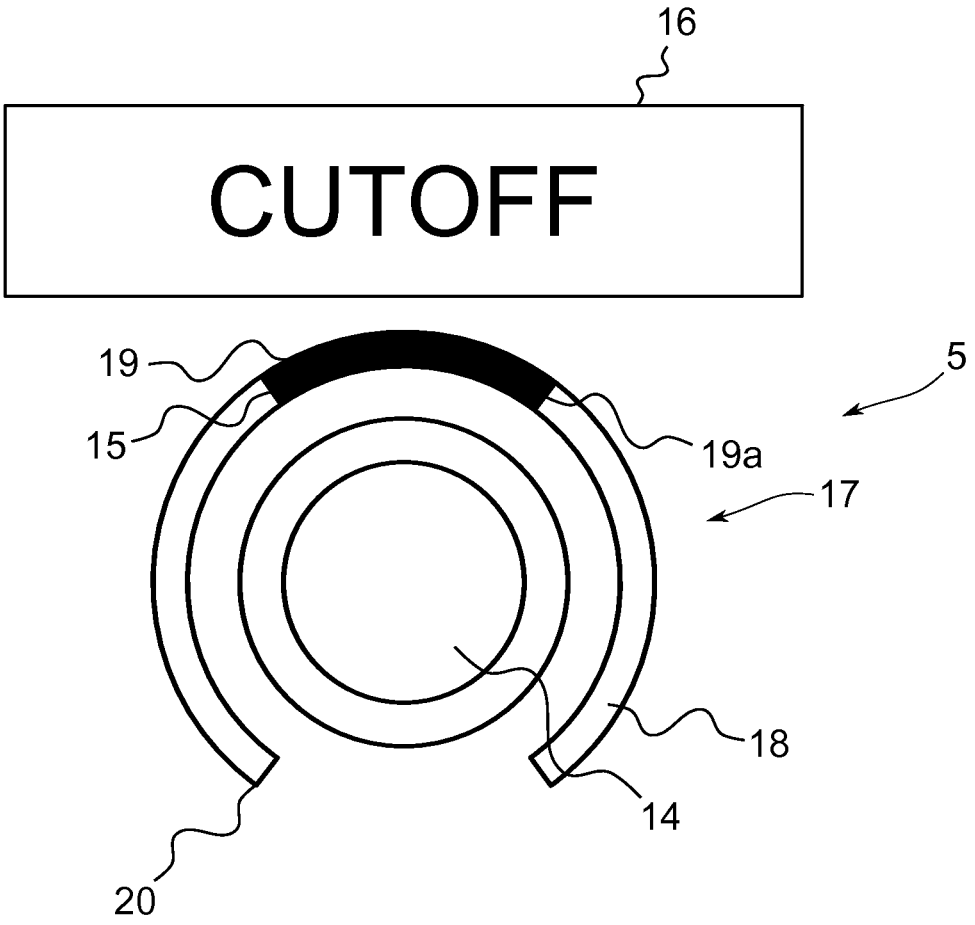
Figure 5:
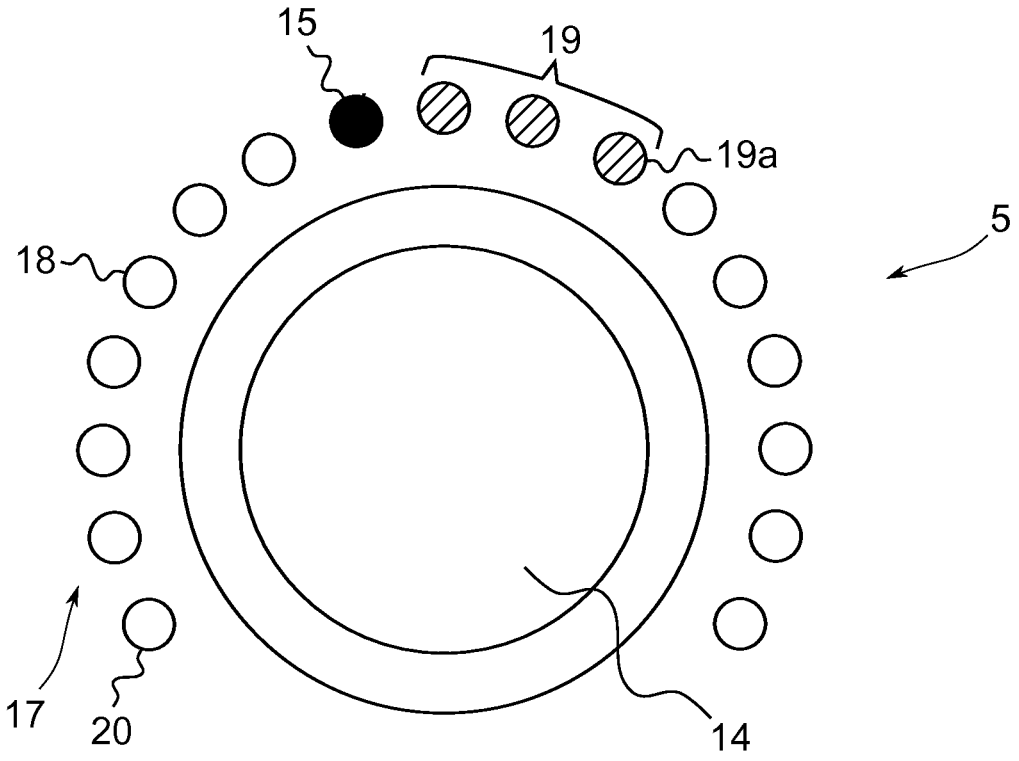

FIG. 3 a schematic diagram of an absolute rotary encoder of the electronic music instrument;

FIG. 4 a schematic diagram of a relative rotary encoder of the electronic music instrument; and FIG. 5 a schematic diagram of a further relative rotary encoder of the electronic music instrument.

FIG. 1 shows a system 1 with an electronic music instrument 2 and a data processing device 3 as a block diagram. The electronic music instrument 2 may be a keyboard instrument, a synthesizer or a sample-based instrument. The electronic music instrument 2 may further be a control or effect device like a mixer. Here, the electronic music instrument 2 has a hardware keyboard 4 with a plurality of keys. The keyboard 4 may for example include 25, 49 or 61 keys.

The electronic music instrument 2 includes a number of rotary encoders 5 for adjusting parameters or values of parameters, which are arranged for example in a control section of the electronic music instrument 2. The parameters may include instrument and play assistant parameters. In the control section, additional displays are provided that provide visual feedback to the user. The rotary encoders 5 may be implemented as endless and/or touch-sensitive encoders. The number of rotary encoders 5 depends on the demands on and the design of the electronic music instrument 2. In this example, the number of rotary encoders 5 ranges from two to sixteen, preferably eight. For the ease of understanding only one rotary encoder 5 is shown in the Figures. The parameter may be mapped electronically to the encoder 5. In the alternative, the parameter or the function may be connected in hardware with the encoder 5. Hence, the assignment or allocation between a parameter and an encoder 5 may be variable or fixed.

A communication link 6 like a data line or a bus system connects the electronic music instrument 2 with the data processing device 3. Signals or sound generated by keys of the keyboard 4 are provided to the data processing device 3 via the communication link 6. The communication link 6 has bidirectional capabilities. Control signals settings, parameter values and the like input for example via the keyboard 4 or the rotary encoder 5 are transferred from the electronic music instrument 2 to the data processing device 3. From the data processing device 3 on the other hand, control signals, settings, parameter values and the like are transferred to the electronic music instrument 2. The signals, the communication link 6, protocols and/or interfaces as well as the electronic music instrument 2 and the data processing device 3 may be compatible to the MIDI standard, USB standard (Universal Serial Bus) or other standards known from computers or music instruments.

When working with the electronic music instrument 2 or playing an instrument like the electronic music instrument 2, one or more software programs, instruments, routines or plugins are used or executed in serial or parallel. Such software can be executed on the electronic music instrument 2, the data processing device 3 and/or further devices.

With regard to FIG. 2 the electronic music instrument 2 is now described in detail. The electronic music instrument 2 has one or more parameters 7 for setting up the electronic music instrument 2 or for changing it's behavior. In this example of the music field the parameter 7 is an instrument or play assistant parameter including for example cutoff, boost, bandwidth, reverb and decay.

The parameter 7 can be accessed or influenced in various ways. Via the rotary encoder 5 a base value 8 of the parameter 7 can be set. The base value 8 of the parameter 7 can also originate from the data processing device 3 via the communication link 6. The base value 8 may further be influenced from a GUI (graphical user interface) on a computer or by a MIDI controller attached to the data processing device 3.

An internal modulation engine 10 provides a modulation offset 9 to the parameter 7 for changing it's value. The internal modulation engine 10 provides additional oscillators, sequencers or envelope followers that are computed inside the internal modulation engine 10 and applied to the parameter. While the influence of the modulation inside the instrument is applied to the new parameter value only momentarily, the changes according to the base value 8 provided by the rotary encoder 5 or by the data processing device 3 are permanent; at least until a new internal or external value is present.

The parameter 7 as well as it's processing or change and the internal modulation engine 10 are executed inside a software module 11. The software module 11 may comprise one or more instances which can be executed on different computational devices 12. Here, one computational device 12 is present, which may be a DSP (digital signal processor), chip or the like in an enclosure common to the keyboard 4. The computational device 12 can be arranged inside the electronic music instrument 2 as shown or it can correspond to the data processing device 3 and/or further devices.

A key of the keyboard 4 generates a signal when it is pressed by a user or player. Via a communication link 13 like a data line or a bus system the signal is provided to the computational device 12 and/or the software module 11.

The software module 11 may encompass further modules, routines, functions or plugins like for example one or more play assistance functions and/or a collection of instrument plugins. According to the signals from the keyboard 4 the software module 11 generates or computes an output signal to be recorded and or played.

FIGS. 3 to 5 show examples of the rotary encoder 5 in detail. The rotary encoder 5 or shaft encoder is an electromechanical device for converting an angular position or motion of a shaft or axle to an analog or digital signal. Two main types of rotary encoders exist, absolute encoders and incremental or relative encoders. Absolute encoders indicate the current position of the shaft. Incremental encoders provide information about the motion of the shaft, which is typically further processed into information such as position or speed. In this exemplary embodiment, the rotary encoder 5 is implemented as an incremental encoder.

The rotary encoder 5 has a handle or knob 14 which can be actuated or operated by the user or player of the electronic music instrument 2. The knob 14 is supported in a rotatory manner; i.e. the rotary encoder 5 can be rotated around an axis of rotation. The position and/or movement of a shaft of the rotary encoder 5 are detected in a known mechanical, optical, magnetic or capacitive manner.

FIG. 3 shows an absolute rotary encoder 5. For indicating the position of the knob 14 or the rotary encoder 5 an indicator 15 is provided at the knob 14. Here, two indicators 15 are present. A first indicator 15*a* is a marking in form of a line on a top surface of the knob 14. A second indicator 15*b* has the form of a protrusion protruding from a base portion of the knob 14. Naturally, both indicators 15*a* and 15*b* point in the same direction. The indicator 15 gives an indication of the base value 8 of the parameter 7. This base value 8 corresponds to the value set by the user or player by rotating the knob 14 or the rotary encoder 5. In case the encoder 5 is optionally motor driven the indicator 15 corresponds to the value set by external devices like the data processing device 3 as well.

A display 16 for example an LCD or TFT display is arranged above the rotary encoder 5 and shows a name or designation of the parameter 7. Here, a cutoff frequency can be changed with the rotary encoder 5. The display 16 may also surround the rotary encoder 5 so that additional information with regard to the parameter 7 like a range or zero point can be displayed close to the rotary encoder 5.

A visual indicator 17 is provided at the rotary encoder 5 for indicating the modulation offset 9 of the parameter 7 and the base value 8 of the parameter 7. The visual indicator 17 encompasses the hardware pointer or indicator 15 and a light emitting indicator 18.

The light emitting indicator 18 is ring-shaped or has the shape of ring segment, respectively. The light emitting indicator 18 surrounds the knob 14 in part, preferably at a range of about 270°. The range of the light emitting indicator 18 may be adapted to the range of movement of the knob 14.

The light emitting indicator 18 may include at least one light emitting diode (LED) advantageously a ring of LEDs. The LEDs can be directly arranged at a surface on which the rotary encoder 5 is arranged or the LEDs can be arranged inside the electronic music instrument 2. In latter case a light guide is present guiding the light to a display element. In the alternative, an LCD can be used to represent the light emitting indicator 18. Preferably, it is the same as the display 16.

A part 19 or area of the light emitting indicator 18 is illuminated or active in dependence of the modulation offset 9. This part 19 is perceivable by the user of the electronic music instrument 2. In FIG. 3, the part 19 or indication of the modulation offset 9 starts at the hardware indicator 15 and ranges to a position corresponding to the modulation offset 9 of the parameter 7.

The rotary encoder 5 and the visual indicator 17 or light emitting indicator 18 both have a zero point 20, which may be marked or not. The indicator 15 shows the base value 8 as a range from the zero point 20 to the indicator 15. The visual indicator 17 shows the modulation offset 9 by it's end 19*a* of the illuminated or active part 19. While the range of the modulation offset 9 reaches from the zero point 20 to the end 19*a* of the part 19, only the part 19 located between the indicator 15 and the end 19*a* is active or illuminated. In this way, the user can see clearly the contribution of the base value 8 by the position of the knob 14 and of the modulation offset 9 by the active part 19 to the value of the parameter 7. The resulting value of the parameter 7 corresponds to the end 19*a* of the active area 19.

FIG. 4 shows a relative rotary encoder 5. Here, no indication of the position of the knob 14 or the rotary encoder 5 is provided at the knob 14 as the relative rotary encoder 5 has no absolute positions.

A display 16 for example an LCD or TFT display is arranged above the rotary encoder 5 and shows a name or designation of the parameter 7. Here, a cutoff frequency can be changed with the rotary encoder 5. The display 16 may also surround the rotary encoder 5 so that additional information with regard to the parameter 7 like a range or zero point can be displayed close to the rotary encoder 5.

A visual indicator 17 is provided at the rotary encoder 5 for indicating the modulation offset 9 of the parameter 7 and the base value 8 of the parameter 7. The visual indicator 17 encompasses the light emitting indicator 18. The indicator 15 is realized by the light emitting indicator 18.

The light emitting indicator 18 is ring-shaped or has the shape of ring segment, respectively. The light emitting indicator 18 surrounds the knob 14 in part, preferably at a range of about 270°.

The light emitting indicator 18 may include at least one light emitting diode (LED) advantageously a ring of LEDs. The LEDs can be directly arranged at a surface on which the rotary encoder 5 is arranged or the LEDs can be arranged inside the electronic music instrument 2. In latter case a light guide is present guiding the light to a display element. In the alternative, an LCD can be used to represent the light emitting indicator 18. Preferably, it is the same as the display 16.

A part 19 or area of the light emitting indicator 18 is illuminated or active in dependence of the base value 8 and the modulation offset 9. This part 19 is perceivable by the user of the electronic music instrument 2. The position of the left end 15, also referred to as indicator 15, of the active part 19 corresponds to the base value 8. Compared to FIG. 3 the left end 15 of FIG. 4 corresponds to the pointer 15 of FIG. 3. This indication 15 of the base value 8 corresponds to the value set by the user or player by rotating the knob 14 or the rotary encoder 5 or to the value set by external devices like the data processing device 3.

The part 19 or indication of the modulation offset 9 starts at the left or lower end 15 and ranges to a position 19*a* corresponding to the modulation offset 9 of the parameter 7.

The rotary encoder 5 and the visual indicator 17 or light emitting indicator 18 both have a zero point 20, which may be marked or not. The visual indicator 17 or the light emitting indicator 18 may have the form of a complete ring, i.e. fully surrounding the knob 14. The zero point 20 may then be realized as an active or switched on part of the light emitting indicator 18.

The indicator 15 shows the base value 8 as a range from the zero point 20 to the indicator 15. This range is not visible active or illuminated. The visual indicator 17 shows the modulation offset 9 by it's end 19*a* of the illuminated or active part 19. While the range of the modulation offset 9 reaches from the zero point 20 to the end 19*a* of the part 19, only the part 19 located between the indicator 15 and the end 19*a* is active or illuminated. In this way, the user can see clearly the contribution of the base value 8 by the left or lower end 15 and of the modulation offset 9 by the active part 19 to the value of the parameter 7. The resulting value of the parameter 7 corresponds to the right or upper end 19*a* of the active area 19.

FIG. 5 shows another example of the rotary encoder 5 and the visual indicator 17. Here, the light emitting indicator consists not of a band of visual elements or a one-piece visual element like in FIGS. 3 and 4. Instead, the visual indicator 17 includes single or distinct light emitting indicators 18 for example in the form of an RGB LED or the like.

A part 19 or three light emitting indicators of the visual indicator are illuminated or active in dependence of the base value 8 and the modulation offset 9. This part 19 is perceivable by the user of the electronic music instrument 2. The position of the light emitting indicator 15, also referred to as indicator 15, corresponds to the base value 8. This indication 15 of the base value 8 corresponds to the value set by the user or player by rotating the knob 14 or the rotary encoder 5 or to the value set by external devices like the data processing device 3.

The part 19 or indication of the modulation offset 9 starts at the next light emitting indicator right to indicator 15 and ranges to an indicator 19*a* corresponding to the modulation offset 9 of the parameter 7.

The rotary encoder 5 and the visual indicator 17 both have a zero point 20, which may be marked or not. The visual indicator 17 may have the form of a complete ring, i.e. fully surrounding the knob 14. The zero point 20 may then be realized as an active or switched on part of the light emitting indicator 18. Here, the zero point 20 is indicated by the first light emitting indicator in the lower left corner.

The indicator 15 shows the base value 8 as a range from the zero point 20 to the indicator 15. This range is not visible active or illuminated. The visual indicator 17 shows the value of the modulation offset 9 by its end 19*a* of the illuminated or active part 19. While the range of the modulation offset 9 reaches from the zero point 20 to the end 19*a* of the part 19, only the part 19 located between the indicator 15 and the end 19*a* is active or illuminated. In this way, the user can see clearly the contribution of the base value 8 by the left or lower end 15 and of the modulation offset 9 by the active part 19, i.e. the three visual indicators 19, to the value of the parameter 7. The resulting value of the parameter 7 corresponds to the right or upper end 19*a* of the active area 19.

According to FIGS. 3 to 5 the modulation offset 9 is larger than the base value 8 so that the active area 19 is right or clockwise from the indicator 15. Hence, the active part 19 of the visual indicator 17 corresponds to a subtraction of the base value 8 from the modulation offset 9. It could also be that the modulation offset 9 is smaller than the base value 8 so that the active area 19 is left or counter-clockwise from the indicator 15. Hence, the active part 19 corresponds in that case to a subtraction of the modulation offset 9 from the base value 8. In other words, the active part 19 corresponds to the difference between the two values 8, 9 for the parameter 7.

Once a new resulting value is computed for the parameter value based upon a new modulation offset 9 the visual indicator 17 is activated or updated. This includes drawing or redrawing the active part 19 based upon the computation of the resulting value of the parameter 7. The computation and/or the control of the visual indicator 17 may be executed by the software module 11, the computational device 12 and/or the data processing device 3.

The invention claimed is:

1. An electronic music instrument comprising at least one rotary encoder with a knob configured for setting a value of a parameter of the instrument;

at least one input configured for receiving at least one of a base value of the parameter and a modulation offset of the parameter; and a visual indicator associated with the encoder configured for indicating the base value of the parameter and the modulation offset of the parameter.

2. The electronic music instrument according to claim 1, wherein the visual indicator comprises a plurality of LEDs.

3. The electronic music instrument according to claim 1, wherein the visual indicator is ring-shaped at least partly surrounding the knob.

4. The electronic music instrument according to claim 1, wherein the visual indicator is configured for indicating the modulation offset starting at the base value.

5. The electronic music instrument according to claim 1, wherein the visual indicator is configured for temporarily changing its appearance when a base value of the parameter or a modulation offset of the parameter is received.

6. The electronic music instrument according to claim 1, wherein the rotary encoder is an absolute encoder and wherein the visual indicator comprises a light emitting indicator configured for displaying the modulation offset and a hardware pointer configured for displaying the base value.

7. The electronic music instrument according to claim 1, wherein the rotary encoder is a relative encoder and wherein the visual indicator comprises a light emitting indicator configured for displaying the modulation offset and the base value.

8. The electronic music instrument according to claim 1, wherein the parameter is an instrument parameter or play assistant parameter.

9. The electronic music instrument according to claim 1, further comprising an internal modulation engine for providing a modulation offset of the parameter to the input.

10. A system comprising the electronic music instrument according to one of claims 1 to 9 and a data processing device.

11. The system of claim 10, wherein the data processing device is a digital audio workstation and is configured for providing a base value of the parameter to the input.

12. The system of claim 10, wherein a controller configured for providing a base value of the parameter is connected to the data processing device and wherein the data processing device is configured for providing the base value of the parameter to the input.

13. A method for operating an electronic music instrument having at least one rotary encoder with a knob, wherein a value of a parameter of the instrument is set by rotating the knob; at least one of a base value of the parameter and a modulation offset of the parameter is received; and the base value of the parameter and the modulation offset of the parameter is indicated by a visual indicator associated with the encoder.

14. The method according to claim 13, wherein an indication of the modulation offset starts at an indication of the base value.

15. The method according to claim 13, wherein the modulation offset is displayed by a light emitting indicator and wherein the base value is displayed by a hardware pointer.

16. The method according to claim 13, wherein the base value and the modulation offset are displayed by a light emitting indicator.

* * * * *